US006554747B1

(12) United States Patent
Rempe

(10) Patent No.: US 6,554,747 B1
(45) Date of Patent: Apr. 29, 2003

(54) EXERCISE DEVICE AND METHOD OF USE THEREOF

(76) Inventor: Douglas F. Rempe, 7380 Lake Park Dr., West Chester, OH (US) 45069

( * ) Notice: Subject to any disclaimer, the term of this patent is extended or adjusted under 35 U.S.C. 154(b) by 0 days.

(21) Appl. No.: 09/821,946

(22) Filed: Mar. 30, 2001

(51) Int. Cl.[7] ..... A63B 1/00

(52) U.S. Cl. ..... 482/38; 482/69; 482/39; 482/43

(58) Field of Search ..... 482/38–39, 43, 482/69, 23, 140–143, 24, 41, 121, 124, 126, 27–29; 5/83.1, 88.1

(56) References Cited

U.S. PATENT DOCUMENTS

| | | | | | |
|---|---|---|---|---|---|
| 725,876 | A | | 4/1903 | Roche | |
| 4,848,741 | A | | 7/1989 | Hermanson | |
| 4,921,245 | A | * | 5/1990 | Roberts | 482/42 |
| 4,961,574 | A | * | 10/1990 | Lew | 472/17 |
| 5,178,590 | A | * | 1/1993 | Stephens | 482/43 |
| 5,221,241 | A | * | 6/1993 | Bare, II | 482/43 |
| 5,234,394 | A | | 8/1993 | Wilkinson | |
| 5,265,589 | A | | 11/1993 | Wang | |
| 5,290,209 | A | | 3/1994 | Wilkinson | |
| 5,306,222 | A | | 4/1994 | Wilkinson | |
| 5,330,400 | A | | 7/1994 | Huberman | |
| 5,360,384 | A | * | 11/1994 | Toensing | 482/43 |
| 5,403,253 | A | * | 4/1995 | Gaylord | 482/43 |
| 5,415,608 | A | | 5/1995 | Bode et al. | |
| 5,431,617 | A | | 7/1995 | Rattray, Jr. | |
| 5,478,299 | A | | 12/1995 | Harmon et al. | |
| 5,577,984 | A | * | 11/1996 | Bare, II | 482/43 |
| 5,593,368 | A | * | 1/1997 | Checketts | 482/27 |
| 5,813,955 | A | | 9/1998 | Gutkowski et al. | |
| 5,857,945 | A | | 1/1999 | Papp et al. | |
| 6,099,445 | A | | 8/2000 | Rovinsky et al. | |
| 6,280,361 | B1 | * | 8/2001 | Harvey et al. | 482/8 |

* cited by examiner

*Primary Examiner*—Nicholas D. Lucchesi
*Assistant Examiner*—Lori Baker Amerson
(74) *Attorney, Agent, or Firm*—Daniel F. Nesbitt

(57) ABSTRACT

An exercise device for allowing a user to perform functional tasks during training or exercise. The exercise device has a housing and a harness assembly adapted to be worn by the user. The harness assembly is located substantially within the housing. The exercise device also has at least one biasing member. The biasing member has a longitudinal length, a first end, and a second end. The biasing member is further in cooperation with the harness assembly at its first end and with the housing at its second end.

19 Claims, 6 Drawing Sheets

EXERCISE DEVICE AND METHOD OF USE THEREOF

FIELD OF THE INVENTION

The present invention relates, in general, to exercise devices, and more particularly, to rehabilitative exercise devices and methods.

BACKGROUND OF THE INVENTION

Exercise equipment has long been used to rehabilitate injured persons. However, current systems yield only limited functionality since they limit the freedom of movement allotted to a user.

It has been shown that functional exercises consist of functional activity as well as proprioceptive awareness. Proprioceptive awareness consists of three elements vestibular, visual, and somatosensory, the later two providing the most feedback for body/joint awareness. Injury primarily impairs somatosensory receptors, therefore, decreasing a patient's kinesthetic awareness. Functional weight baring activities causing joint deformation and loading of soft tissue will help to reestablish a patent's proprioceptive feedback. (Lephart, SM, Pincivero, DM, Giraldo, JL, Fu, FH, The role of proprioception in the management and rehabilitation of athletic injuries. *Am. J. Sports Med* 25. (1) 1997: 130–7. Methods to increase the patients proprioception are commonly done with the use of restive bands, but have only been performed in a unidirectional patterns. To date there is no research available assessing proprioceptive and resistive training in multiplanar motion. (Spence, AT, Multiple-plane surgical tubing/band kicks. *Strenth and Conditioning*, 20. (6)1998: 55–7.

According to Lephart et al. rehabilitation programs should contain a proprioceptive component, which is recommended to promote dynamic joint and functional stability (1997). Lack of proprioceptive feedback results with incomplete or inadequate neuromuscular pathways, which can predispose a person to reinjury. Resistance from multiple angles is believed to cause greater disruption to balance than resistance in a single plane. This disruption in balance forces the body to respond to additional stimuli, which increases proprioceptive development (Spence, 1998).

The goal of physical rehabilitation is to return a user to their level of activity as soon as possible. This includes the ability to once again perform daily tasks, such as ambulation, climbing stairs, and other activities. To accomplish this goal, rehabilitation exercise that simulates normal activity of a user seems to be most effective. During many functional tasks, the lower extremities are used in a closed kinetic chain (with the foot on the ground) which is very demanding on the muscles, ligaments, and other structures. It has been shown that muscular adaptations are directly related to their activities, and it is therefore believed that initial rehabilitation training should focus on functional tasks. Despite this, open kinetic chain activities are often the most common initial exercise performed in rehabilitation, even though closed chain functional exercise may provide faster return to normal activities after injury to the lower extremities and back. Unfortunately, the use of closed chain activity early in the rehabilitation process is often limited by the inability to bear weight on injured or compromised structures. Full weight bearing on these structures can increase pain, inflamation, and tissue damage, which would prolong the healing process.

To optimize the rehabilitation of a user an exercise device should maximize the benefit of functional activities while minimizing the overload effects of full weight bearing by using a process of partial body weight support ("PBWS"). The PBWS aspect of the exercise device would give the necessary support for a user that is unable to stand or walk due to weakness, disequilibrium, or paralysis. The device would also provide the prospect of performing functional activities in an upright position without having to completely weight bear. Current PBWS devices restrict the amount of area to accomplish necessary movements, thus the recovering sports injury user is restricted to the limited space, disabling him from performing necessary sports specific activities. Current PBWS devices also do not allow progressive resistive training and exercises, specific training, and plyometrics.

Therefore, a device which provides the versatility of PBWS for a user along with the prospect of progressive resistance all while working in multi planar directions would be a useful device.

Accordingly, it is an object of the present invention to alleviate the above-described problems and shortcomings of the exercise devices heretofore available to physical therapists and athletic trainers.

SUMMARY OF THE INVENTION

In an exemplary embodiment of the invention, a user performs functional tasks during training or exercise using the exercise device. The exercise device has a housing and a harness assembly that is worn by the user. The harness assembly is located substantially within the housing and is connected to the housing by at least one biasing member. The biasing member has a longitudinal length, a first end, and a second end. The biasing member is in cooperation with the harness assembly at the first end of the biasing member and with the housing at the second end of the biasing member.

In another exemplary embodiment of the invention, a user performs functional task with a rehabilitation exercise device during rehabilitation training or exercise. The rehabilitation exercise device has a housing and a harness assembly that is adapted to be worn by a user. The rehabilitation exercise device also has at least two biasing members. The biasing members have a longitudinal length, a first end, and a second end. Each of the biasing members are in cooperation with the harness assembly at the first end of the biasing member and with the housing at the second end of the biasing member. However, the biasing members are in cooperation with the housing at a height higher than the harness. In an additional embodiment, the biasing members are in cooperation with the housing at a height lower than the harness.

The exercise device of the current invention is further directed to a method of exercising and allows the user to perform functional tasks during training or exercise. The first step is to put the harness assembly on the user. The second step is to attach the first end of the biasing members to the harness assembly. With the user located within the housing, the third step is to attach the second end of the biasing members to the housing. The user is now secured within the housing by the harness assembly and biasing members and may now perform functional tasks during training or exercise. An appropriate program for using the exercise device should be selected by one skilled in the art.

Advantages and novel features of the present invention will become apparent to those skilled in the art from the following detailed description, which simply illustrates various modes and examples contemplated for caring out the invention. As will be realized, the invention is capable of other different aspects, all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention, it is believed that the same will be better understood from the following description, taken in conjunction with the accompanying drawings, in which:

DETAILED DESCRIPTION

Reference will now be made in detail to various exemplary embodiments of the present invention, examples of which are illustrated in the accompanying drawings wherein like numerals indicate the same elements throughout the views and numbers with the same final two digits indicate corresponding elements among embodiments.

As will be understood hereafter, the most preferred embodiment of the present invention relate to partial body weight support, PBWS, exercise devices. While the present invention is described hereafter with respect to a preferred PBWS exercise device for providing progressive resistance while working in multi-planar directions, it should be understood that the present invention can be adapted for any other uses and applications to exercising or performing functional tasks while exercising.

Figure 1:
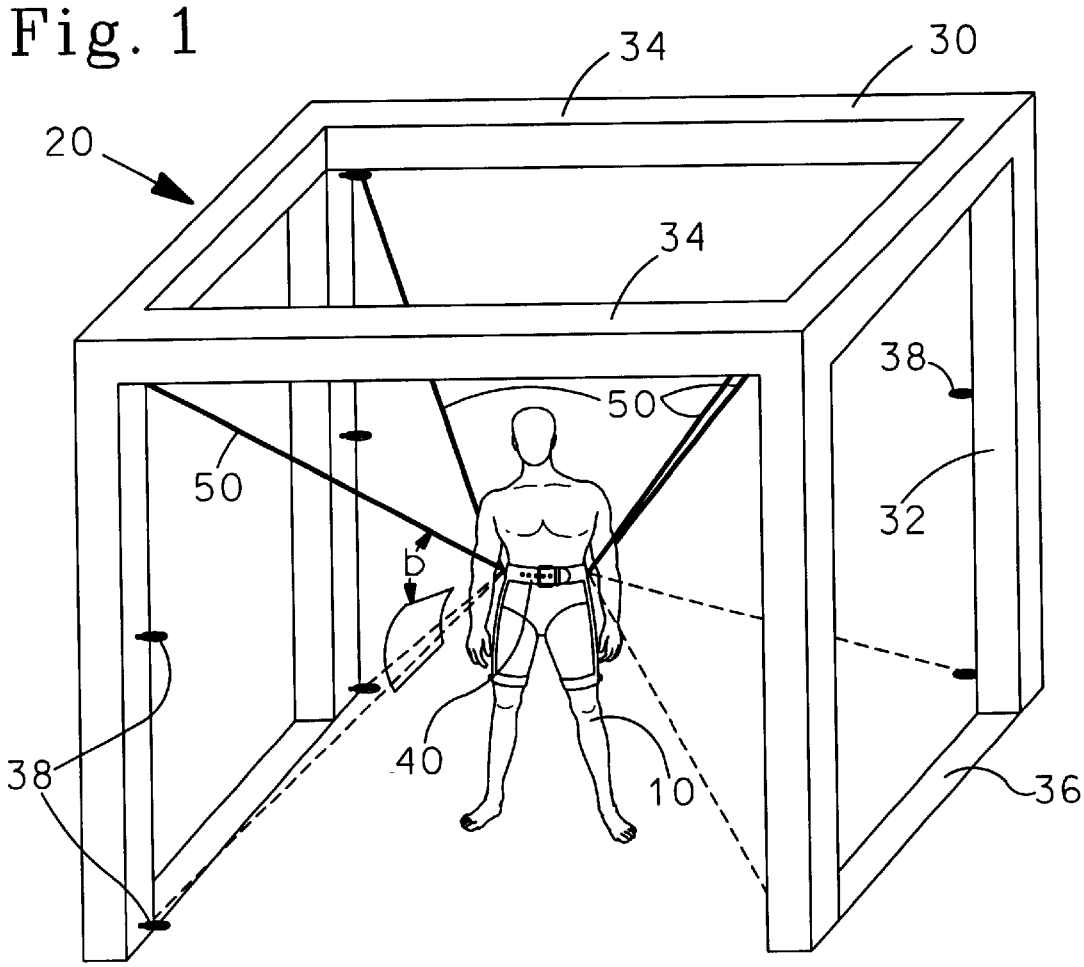
FIG. 1 is a perspective view of an exemplary embodiment of an exercise device made in accordance with the present invention illustrated with a user.

FIG. 1 depicts a non-limiting exemplary embodiment where an exercise device 20 is used by a user 10. It is contemplated that the exercise device 20 can be provided in a variety of forms and structures wherein a user 10 may perform functional tasks during training or exercise. While the combination of the exercise device and a user is illustrated, other arrangements may equally be substituted as well. For example, the present invention may also be in use with other exercise or athletic equipment such as a treadmill (FIG. 4) an exercise mat (FIG. 7), a set of stairs (FIG. 8), a stair machine (not shown), a ball (not shown), a Swiss ball, a Heiden ball, a trampoline, a balance board, a biomechanical ankle platform system (baps), or a foam bolster.

The exemplary embodiment of the exercise device 20 in FIG. 1 has a housing 30, a harness assembly 40, and biasing members 50. The housing 30 has legs 32, cross members 34, a base 36 and housing connectors 38. The housing of the exercise device could have a variety of different structures in alternative embodiments. For example, the housing of the exercise device in a separate embodiment may be a room (not shown). Further, as may be compared with the embodiment depicted in FIG. 1, part of the exercise device could be eliminated in alternative embodiments. For example, the base could be eliminated, wherein the legs would stand on their own accord. Similarly, the cross members could be eliminated. While the structure of the housing may vary widely, the user, and thus the harness assembly worn by the user, will typically be located substantially within the housing during use of the exercise device. This will become clearer from the following discussion and some deviation will be apparent to those skilled in the art. For example, a user might step slightly beyond the perimeter of the housing without deviating from the current invention.

Figure 2:
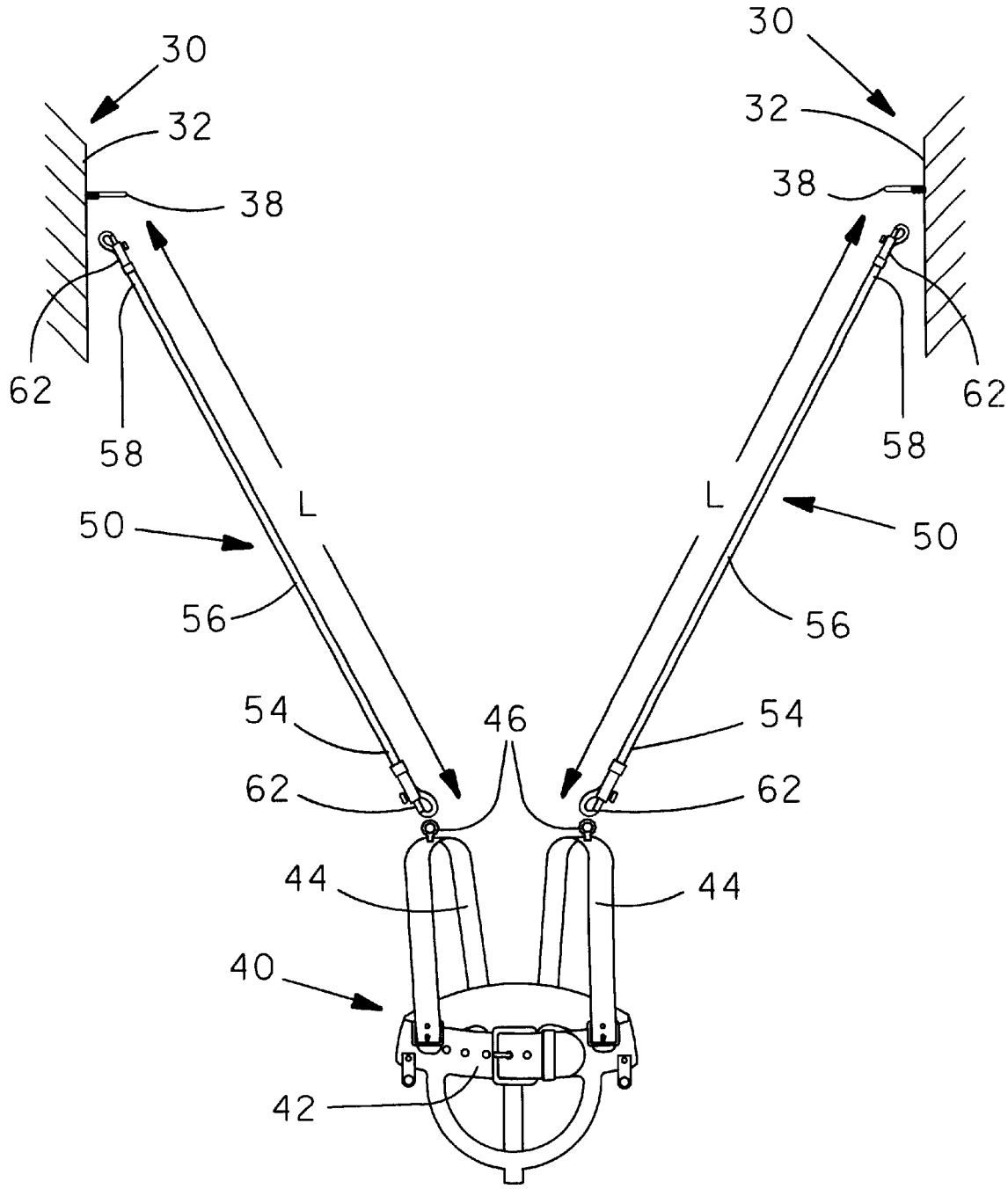
FIG. 2 is a partial, exploded view of an exemplary embodiment of an exercise device made in accordance with the present invention.

FIG. 2 shows a partial view of another non-limiting exemplary embodiment of an exercise device 20 having a housing 30, a harness assembly 40, and biasing members 50. FIG. 2 is the same as FIG. 1 except that shoulder straps 44 have been added to the harness 40 and only two biasing members 50 are shown. Since FIG. 2 only adds the shoulder straps 44 to FIG. 1, the numerals are the same in each drawing. In FIG. 2 a biasing member 50 has a longitudinal length L. Further, the biasing member 50 has a first end 54 and a second end 58. Both the first end 54 and the second end 58 are shown having biasing member connectors 62. However, it is contemplated that the biasing members could have a plurality of connectors along the length L that are capable of being attached to the harness assembly or the housing of the exercising device. The biasing member 50 of FIG. 2 is shown as having a single strand 56. Multiple strand biasing members are also contemplated in alternative embodiments as will be discussed in further detail.

The harness assembly may be of a variety of embodiments as known to those skilled in the art. FIG. 2 depicts an embodiment of a harness assembly 40. The harness assembly 40 may have a belt 42, shoulder straps 44, and harness connectors 46. Having the biasing members attached to the shoulders versus the waist may give the user more stability, i.e. less likelihood of the user going head over heels. Alternative embodiments of the harness assembly, such as depicted in FIG. 1, may not include the shoulder straps while other embodiments, such as will be discussed later in FIG. 6, may have additional straps and connectors.

Figure 6:
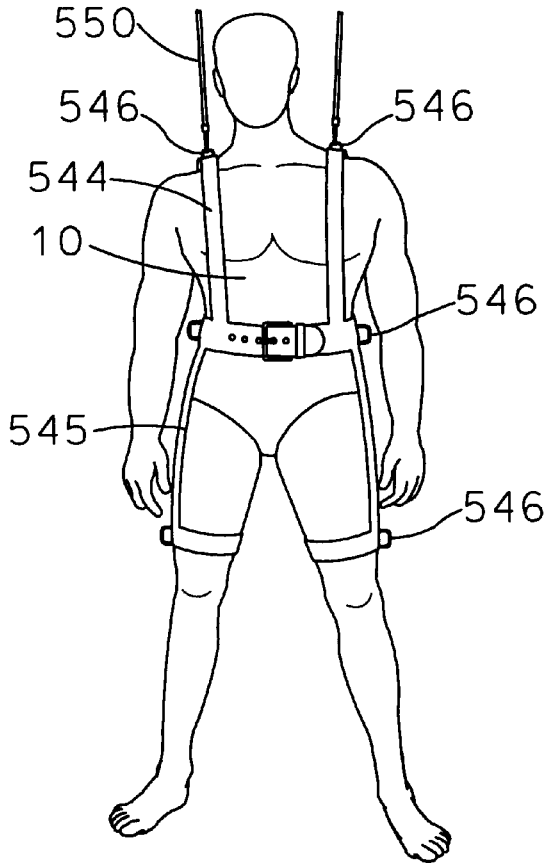
FIG. 6 is a schematic view of a harness of an exercising device made in accordance with the present invention illustrated with a user.

In an exemplary use of the exercise device of the current invention and as shown in FIG. 1, the harness assembly 40 would be worn about the torso of a user 10. As seen in FIG. 2, biasing members 50 may be connected to the harness assembly 40 at the biasing member first end 54. In one embodiment of the exercise device 20 the harness connectors 46 on the harness assembly 40 may be D-rings. The biasing connector 62 on the first end 54 of the biasing member 50 might be a snap hook having a swivel. As would be obvious to one skilled in the art, the harness assembly connector 46 and the biasing member connector 62 could have various configurations. For example, the connectors could be made of Velcro®, they could be a hook and eye assembly, or they could be any of various buckles such as a harness buckle or a squeeze buckle. The biasing members could be connected to the harness assembly at the user's waist as in FIG. 1, at the user's shoulders as in FIG. 6, at the user's limbs, or at any location or combination of locations as would be obvious to one skilled in the art. FIG. 6 also shows a harness having adjustable leg straps 545. The leg straps 545 could be adjusted both in length along the leg of a user 510 and in diameter around the user's leg. In FIG. 6, the biasing members 550 are attached to the shoulder straps 544 of the harness by the harness connectors 546.

Also in FIG. 2, the biasing member 50 of the exercise assembly 20 may be connected to the housing 30 at the biasing member second end 58. The housing may have housing connectors along its legs, coss members, and base. The housing connectors 38 in one embodiment are steel eyelets. The second end 58 of the biasing member 50 in this embodiment would also be a snap hook arrangement. Again, the housing connectors 38 and the biasing member connectors 62 could be of a variety of configurations such as a hook and ring combination as would be obvious to those skilled in the art. Biasing member connectors 62 will typically be of the same configuration on each end of a biasing member, and from biasing member to biasing member, to optimize the flexibility in using the exercise device. Additionally, the biasing member could have a plurality of connectors along its length.

The biasing member 50 can be a single strand 66 as shown in FIG. 2. The strand 66 of the biasing member 50 may be made of an elastic cord. This may be a bungee cord, rubber strap, or of any other elastic type material. In an alternate embodiment, the biasing member strand could also be made of springs (not shown) In yet another embodiment, the biasing member strand could be a solid, or non-elastic member used to support or maintain the position of a user (not shown).

Figure 3:
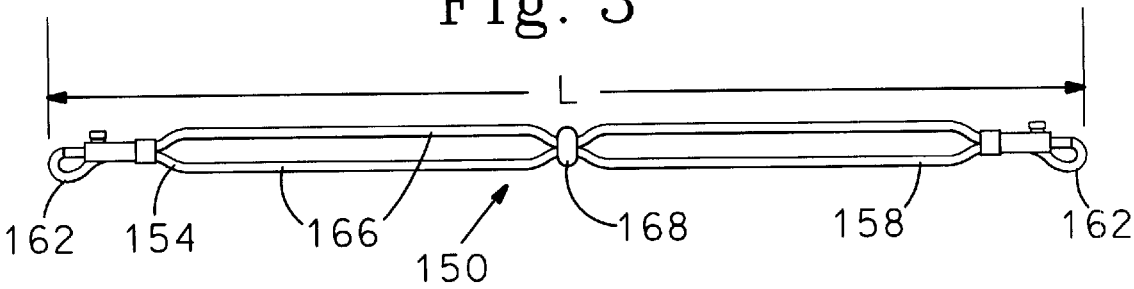
FIG. 3 is a schematic view similar to that of FIG. 2 of an alternative embodiment of the biasing member of the exercise device made in accordance with the present invention.

FIG. 3 depicts the alternative embodiment discussed earlier in which the biasing member 150 can be a dual strand 166. The dual strand design shown in FIG. 3 has a strand connector or adjuster 168. A housing connector or a harness connector would be adapted to receive the adjuster 168. The adjuster 168 is adjustable and may be fixed at any point along the length L of the biasing member 150. The adjuster could be of a variety of configurations known to those skilled in the art. For example, the adjuster could be a ratchet type adjuster. In another embodiment, either the connector at the first end 154 or the connector at the second end 158 could be eliminated while the adjuster may extend along the length of the biasing member to the end not having a connector. In yet another embodiment, the adjuster could be a knot made by merely tying the two strands together.

As stated previously and as depicted in FIG. 1, FIG. 4 and FIGS. 6–8, in operation a user is secured by the harness 40. The biasing members 50 are attached to the harness assembly 40 and then to the housing 30. Alternatively, the biasing members 50 could be attached to the housing 30 first, and then to the harness assembly 40. A biasing angle "b" is defined as the angle created by the intersection of an imaginary horizontal plane "H" at a harness assembly connector 46 with a biasing member 50 attached to the connector 46. By attaching the biasing members 50 to the housing 30 at a height greater than the height that the biasing member 50 is attached to the harness 40, the angle b is considered a positive angle. When the angle b is at a positive angle the force of tension of the biasing member 50 adds lift to the user 10. The lift added to the user decreases the downward force exerted by the user's body, i.e., the weight of the user, during use of the exercise device. This is called de-weighting. By increasing the force of tension of the biasing member 50, the weight of the user is further decreased. The force of tension may be increased by adding additional biasing members, using biasing members with a greater force of tension, adjusting the length of the biasing members, or adjusting the angle (height of the housing vs. the height of the harness).

On the other hand, and as depicted as dotted lines in FIG. 1, by attaching the biasing members 50 to the housing 30 at a height less than the height that the biasing member 50 is attached to the harness 40, the angle b is considered as a negative angle. When the angle b is a negative angle, the force of tension of the biasing member 50 adds resistance to the user 10. Thus, as a user becomes stronger or more stable, the biasing members may be lowered to create resistance training. A program for a user may be established where the biasing members are adjusted downward throughout the users rehabilitation training. Further, a combination of biasing members, some at negative angles and some at positive angles, may be used to provide the user with stability while performing resistance training. The biasing members may also be at about the same housing and harness height parallel to the base, at about an angle b of 0°, to provide safety. This keeps the user from falling, but neither provides lift nor resistance. Additionally, at least one of the biasing members may be a solid material to provide additional stability and safety to a user.

In another embodiment of the exercise device made in accordance with the current invention, a plurality of biasing members are available to the user. For example, four sets of biasing members may be provided having four biasing members in each set. The biasing members of each set may have the same force of tension but each separate set has a different force of tension. The number of members in each set and the force of tension of the members may be varied as would be obvious to one skilled in the art. A user may be progressed through a program where the force of tension for lift is decreased as the user strengthens. Then, the program may add resilience as the user strengthens.

Further, the force of tension for lift or resistance may be changed by adding or removing biasing members individually. For example, in the embodiment shown in FIG. 1, two of the biasing members 50 would be to the front of the user 10 and two would be to the back of the user 10 with each equally and oppositely spaced for stability of the user. If the four biasing members are being used in the lift position, removing two of the biasing members would decrease the lift by half, assuming all the members have the same force of tension and remain at the same distance from the user. In this embodiment of the two biasing member configuration, the two remaining biasing members should be moved to the sides of the user and, at an equal distance from the user to maintain stability. Similar combinations may be used as would be obvious to those skilled in the art.

The force of tension for lift, a positive angle b, or resistance, a negative angle b, may also be changed by using biasing members having a plurality of connectors along their length as discussed above. By attaching the biasing members to the housing and harness assembly using biasing members connectors that are close together the force of tension will be increased compared to attaching with biasing member connectors that are further apart.

Also, as seen in FIG. 3 and previously described, the force of tension for lift or resistance may also be changed by using biasing members 150 having adjustors 168. By moving the adjustor closer to the attached connector 162 and then attaching the adjustor 168, the effective length of the biasing member is decreased creating a greater force of tension.

Figure 4:
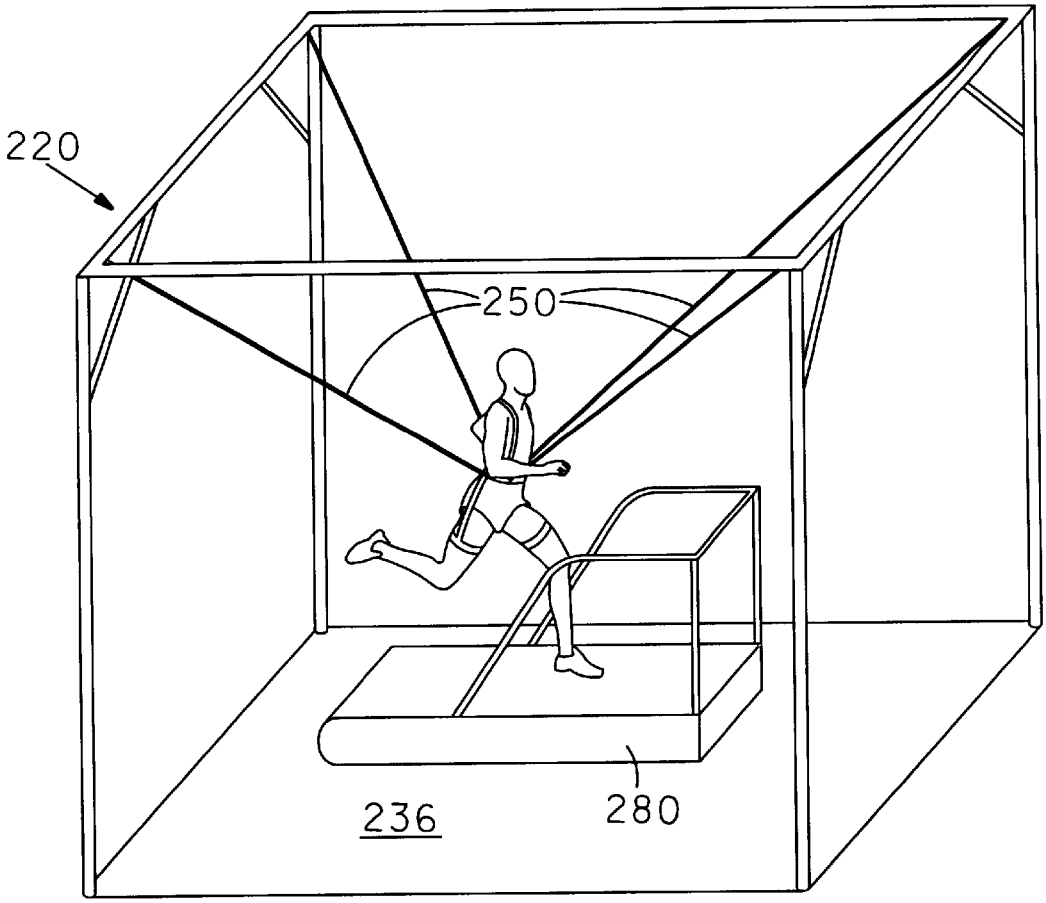
FIG. 4 is a perspective view of an exemplary embodiment of an exercise device made in accordance with the present invention illustrated with a user and a treadmill.
Figure 7:
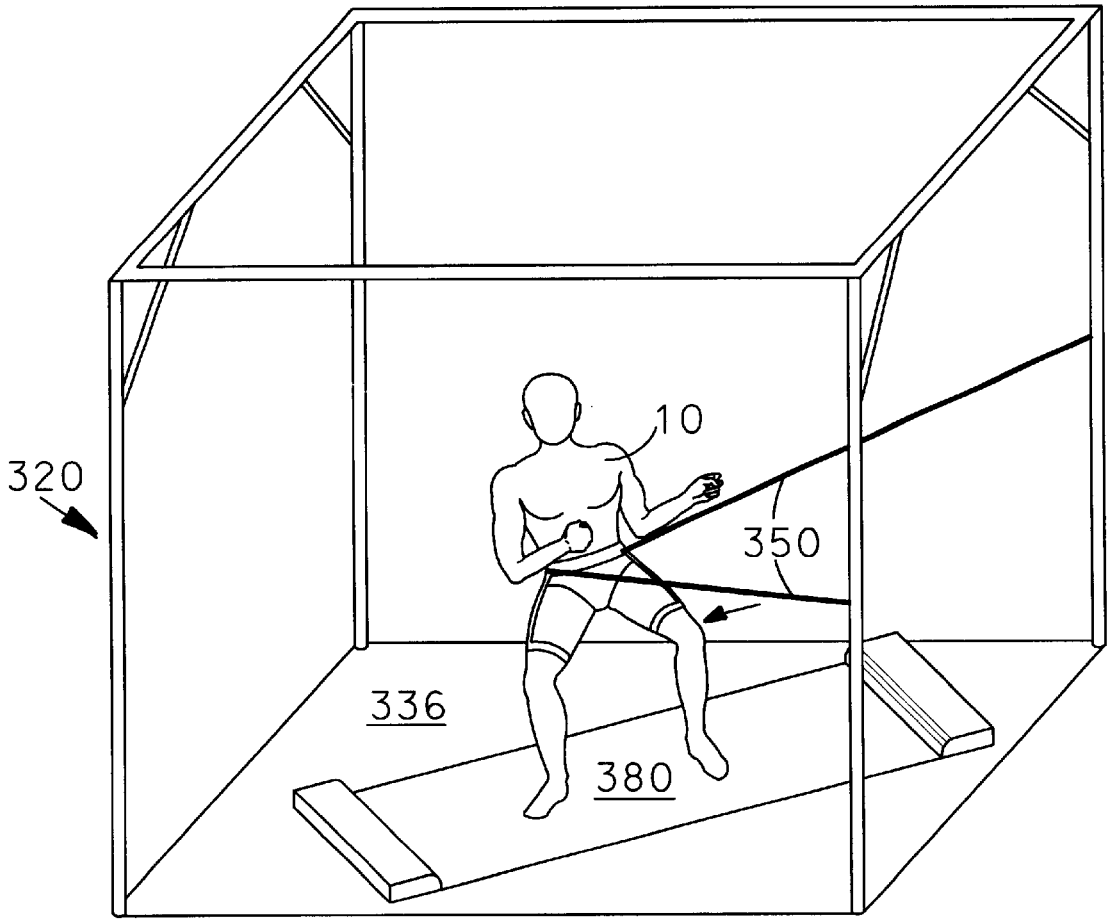
FIG. 7 is a perspective view of an exemplary embodiment of an exercise device made in accordance with the present invention illustrated with a user and a mat.
Figure 8:
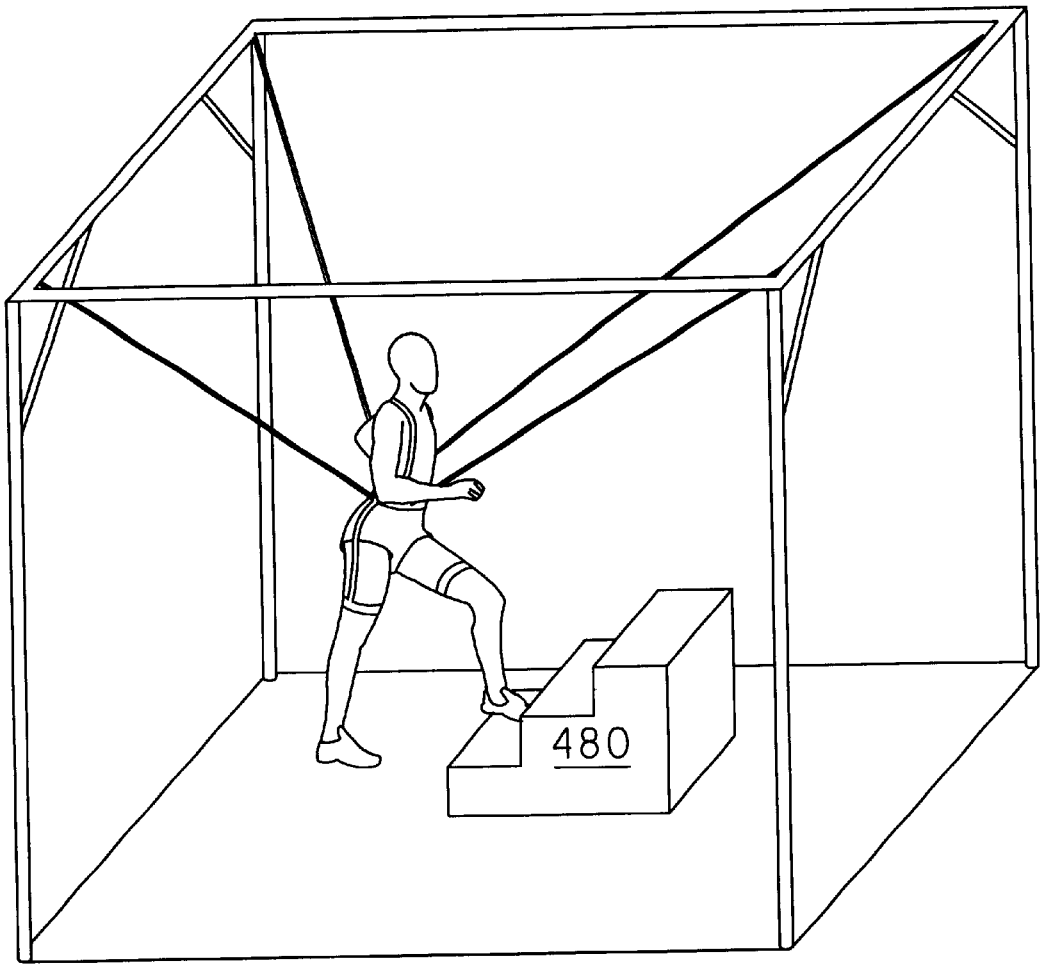
FIG. 8 is a perspective view of an exemplary embodiment of an exercise device made in accordance with the present invention illustrated with a user and a stairs.

In another embodiment of the exercise device made in accordance with the current invention, additional exercise equipment is added to the exercise device to further assist in the user's training and rehabilitation. As seen in FIG. 4, for example, a tread mill 280 may be added at the base 236 of the exercise device 220. The biasing members 250 could be arranged to give lift to a user decreasing the impact on the user's legs while allowing the user to participate in the range of motion required for running. FIG. 7 depicts an embodiment where a mat 380 is added to the base 336 of the exercise device 320. FIG. 7 also shows the user 10 working on side to side motion. As positioned, the biasing members 350 creates horizontal resistance because the biasing members are not spaced to opposite sides of the user. Further, the biasing members add some vertical lift because the angle b is slightly positive. FIG. 8 depicts the user 10 exercising on stairs 480. In yet another example, a ball may be used to hone the user's hand eye coordination while in a standing position where, for example, a user may not otherwise be able to stand because of an injury such as knee or back injury. Combinations of other accessary exercise and athletic equipment may also be used as would be obvious to one skilled in the art.

Figure 5:
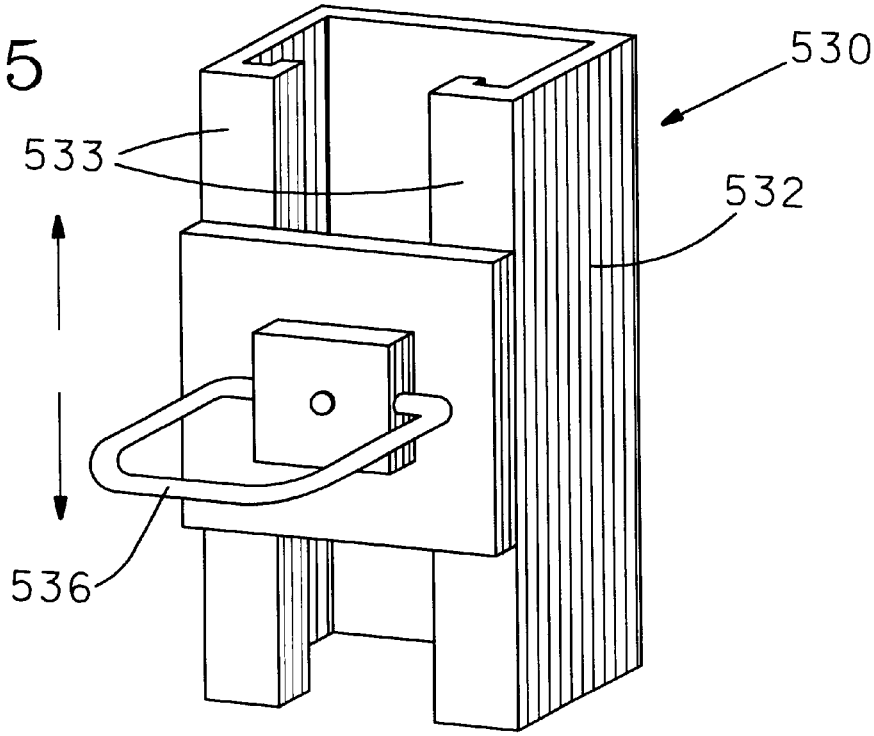
FIG. 5 is a partial, perspective view similar to that of FIG. 2 of an alternative embodiment of a housing leg and a connector of the exercise device made in accordance with the present invention.

FIG. 5 depicts an alternative embodiment of the exercise device of the current invention in partial view. The housing connectors 536 are adjustable along the housing 530. The legs 532 of the housing assembly 530 are adapted to allow the connectors 536 to be connected anywhere along the legs 532. The legs 532 have slotted rails 533 along their length allowing the connectors 536 to be inserted within the rails 533 and clamped to the rails 533. The legs 532 in this embodiment may be made of steel channel. The cross members or base could also be similarly configured. In yet another embodiment, the cross member or the base could be a slotted rail with roller type connectors allowing the biasing members second end to move along the cross member or base as the user moves within the housing. Such an arrangement may allow the user more latitude in performing functional tasks.

The exercise device of the current invention may also me equipped with limb harnesses. Limb harnesses may be adapted as part of the harness assembly or as a connector on the first end of the biasing members. If adapted as the first end of the biasing member, the biasing member would connect directly to the user, for example at the user's wrist, instead of connecting to the harness assembly. The limb harness could be merely a Velcro This embodiment may vary training, for example, by having lift with a body harness while providing resistance to the arms.

The exercise device of the current invention may be used in a variety of exercise and rehabilitation programs. One embodiment of a basic method, see FIG. 1, that allows a user 10 to perform functional task during training or exercise using the exercise device 20 would be to first secure the user with the harness assembly 40. The harness assembly 40 may be of a variety embodiments as previously stated, but is basically adapted to be worn by the user 10. Secondly, attach the first ends 54 of the biasing members 50 to the harness assembly 40. Both the first end of the biasing members and the harness assembly may have connectors for attachment. Then, attach the second end 58 of the biasing members 50 to the housing 30. Again, both the second end of the biasing members and the housing may have connectors for attachment. The housing 30 should be sized so that the user 10 is located substantially within the housing 30. Typically, the user 10 will be in the center of the housing 30 and will be capable of moving about within the housing 30. The user 10 would then be prepared to perform the functional task or tasks. These tasks may be part of a training exercise or a long term rehabilitation program as might be designed by one skilled in the art.

Additional steps to the basic method may be added. For example, the second end 58 of the biasing members 50 may be attached to the housing 30 specifically at a height higher than the harness 40. This provides lift for the user 10 and is especially important in de-weighting the user 10 to minimize impact during performance of the functional task or tasks. The elastic tension force of the biasing members 50 may be decreased either during a single use or over time as the user 10 becomes less dependant on the lift characteristics of the biasing members 50. Multiple steps of decreasing the tension force may be part of a complete planned rehabilitation program. As the user 10 continues to strengthen or to become less dependant on the lift characteristics of the biasing members 50, the second end 58 of the biasing members 50 may be attached to the housing 30 at a height lower than the harness 40. (See dotted lines in FIG. 1.) This provides resistance training to further rehabilitate and/or strengthen the user 10. The elastic tension force of the biasing members 50 may then be increased either during a single use or over time as the user 10 becomes more capable of bearing the resistance characteristics of the biasing members 50. Multiple steps of increasing the tension force may also be part of a complete planned rehabilitation program.

A user can be progressed from a program of simple range of motion exercises up to functional plyometrics. Progression of activities can range from simple cardinal plane motions to multidirectional ballistic training. An additional overhead harness can be used, by a user with safety concerns, to balance the user in order to reduce the risk of falling during functional activities. Use of accessory devices such as a treadmill, an exercise mat, a set of stairs, a stair machine, a ball, a Swiss ball, a Heiden ball, a trampoline, a balance board, a biomechanical ankle platform system, or a foam bolster, as previously discussed, can be incorporated into any functional exercise program.

While certain specific materials and arrangements have been detailed in the above description of exemplary embodiments, these may be varied, where suitable, with similar results. For example, while a steel frame is preferred, the housing may be formed from any suitable material such as wood, plastics, fiberglass, composite materials, or combinations of these or other materials.

Having shown and described the preferred embodiments of the present invention, further adaptions of the exercise device of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the inventive system and process have been discussed for illustrative purposes, it should be understood that the element described will be constantly updated and improved by technology and advances. Similarly, as described, the exercise device of this invention could be applied with just about any user or accessory exercise or athletic equipment such as a treadmill or a ball. Accordingly, the scope of the present invention should be considered in terms of the following claims and is understood not to be limited to the details of structure, operation, or process steps as shown and described in the specification and drawings.

We claim:

1. An exercise device comprising:

(a) a housing comprising a plurality of legs, each leg having a plurality of housing connectors along the leg;

(b) a harness assembly adapted to be worn by a user within the housing, the harness assembly comprising a plurality of connectors; and (c) a plurality of elastic biasing members, the elastic biasing member comprising an elastic cord having a longitudinal length, and having a first end connected to the harness connector and a second end connected to the housing connector, thereby the biasing member forms a biasing angle b;

said elastic biasing member further comprising a first end connector at the first end, a second end connector at the second end, and one or more additional connectors along its length;

whereby the plurality of elastic biasing members apply variable, multi-directional elastic tension forces on the user, the forces being varied by adjusting the biasing angle b of the biasing member by attaching the biasing member second end to a housing connector at a different height along the leg.

2. The exercise device according to claim 1 wherein the plurality of elastic biasing members comprises a first elastic biasing member having a negative biasing angle b, and a second elastic biasing member having a positive biasing angle b.

3. The exercise device according to claim 1 wherein the housing is configured to allow the user freedom of movement therein.

4. The exercise device according to claim 1 wherein the housing comprises four legs, each leg having at least three housing connectors.

5. The exercise device according to claim 1 wherein the elastic biasing member first end comprises a first end connector and the second end comprises a second end connector, and wherein the end connectors comprise a snap hook.

6. An exercise device comprising:

(a) a housing comprising at least three legs, each leg comprising a housing connector adapted to be adjustably connected along the leg;

(b) a harness assembly adapted to be worn by a user within the housing, the harness assembly comprising a plurality of connectors; and (c) a plurality of elastic biasing members, the elastic biasing member comprising an elastic cord having a longitudinal length, a first end connected to the harness connector, and a second end connected to the housing connector thereby the biasing member forms a biasing angle b;

whereby the plurality of elastic biasing members apply variable, multi-directional elastic tension forces on the user, the forces being varied by adjusting the biasing angle b of the elastic biasing member by adjusting the connection of the adjustable housing connectors along the leg.

7. The exercise device according to claim 6 wherein the elastic biasing member comprises a first end connector at the first end, a second end connector at the second end, and one or more additional connectors along its length.

8. The exercise device according to claim 6 wherein the plurality of elastic biasing members comprises a first elastic biasing member having a negative biasing angle b, and a second elastic biasing member having a positive biasing angle b.

9. The exercise device according to claim 6 wherein the housing is configured to allow the user freedom of movement therein.

10. The exercise device according to claim 6 wherein the housing comprises four legs, each leg having at least two adjustable housing connectors.

11. The exercise device according to claim 6 wherein the biasing member first end comprises a first end connector and the second end comprises a second end connector, and wherein the end connectors comprise a snap hook.

12. An exercise device comprising:

(a) a housing comprising a base, the base comprising a plurality of housing connectors, each housing connector being moveable along the base;

(b) a harness assembly adapted to be worn by a user for movement within the housing, the harness assembly comprising at least one connector; and (c) at least one elastic biasing member, the elastic biasing member comprising an elastic cord having a longitudinal length, a first end connected to the harness connector, and a second end connected to the housing connector;

whereby the elastic biasing member has a negative biasing angle b and applies a resistance force upon the user.

13. The exercise device according to claim 12 wherein the position of the base connector is adjustable along the base.

14. The exercise device according to claim 12 wherein the base connector is configured to enable the elastic biasing members second end to move along the base member as the user moves within the housing.

15. The exercise device according to claim 12, comprising at least four elastic biasing members, and wherein the harness comprises at least four harness connectors.

16. An exercise device comprising:

(a) a housing comprising a plurality of housing connectors;

(b) a harness assembly adapted to be worn by a user within the housing, the harness assembly comprising waist portion, at least one shoulder strap, and a plurality of harness connectors positioned on the waist portion and the shoulder strap; and (c) a plurality of elastic biasing members, the elastic biasing member comprising an elastic cord having a longitudinal length, a first end connected to a harness connector, and a second end connected to a housing connector;

whereby the plurality of elastic biasing members apply elastic tension forces on at least a shoulder of the user.

17. The exercise device according to claim 16 wherein the housing is configured to allow the user freedom of movement therein.

18. The exercise device according to claim 16, further comprising at least one limb harness adapted to be worn by the user, the limb harness having a connector, and an elastic biasing member connected to the limb harness connector.

19. The exercise device according to claim 16 wherein the shoulder biasing member and the waist biasing member have different elastic tension forces.

* * * * *